United States Patent [19]

Yi

[11] 4,352,579

[45] Oct. 5, 1982

[54] WRITING IMPLEMENT

[76] Inventor: Hyon P. Yi, 6941 Chimineas Ave., Reseda, Calif. 91335

[21] Appl. No.: 255,045

[22] Filed: Apr. 17, 1981

[51] Int. Cl.[3] ..... B43K 27/02; B43K 21/18

[52] U.S. Cl. ..... 401/19; 401/29; 401/66; 401/84; 401/217; 401/195; 401/52

[58] Field of Search ..... 401/52, 58, 66, 84, 401/19, 17, 209, 195, 217

[56] References Cited

U.S. PATENT DOCUMENTS

| | | | |
|---|---|---|---|
| 241,362 | 5/1881 | Hoffman | 401/84 |
| 261,456 | 7/1882 | Hoffman | 401/66 |
| 290,191 | 12/1883 | Platt | 401/66 |
| 1,427,711 | 8/1922 | Bartle | 401/17 |
| 1,461,437 | 7/1923 | Billman | 401/52 |
| 2,043,250 | 6/1936 | Kasdan | 401/84 |
| 2,519,341 | 8/1950 | Barstow | 401/209 |
| 2,690,735 | 10/1954 | Lopez | 401/17 |
| 2,772,662 | 12/1956 | Tamalunas | 401/84 |
| 3,765,780 | 10/1973 | Guu | 401/17 |
| 3,963,914 | 6/1976 | Browning | 401/195 |

FOREIGN PATENT DOCUMENTS

| | | | |
|---|---|---|---|
| 436161 | 6/1948 | Italy | 401/17 |
| 273977 | 3/1951 | Switzerland | 401/17 |
| 1019675 | 2/1966 | United Kingdom | 401/217 |

*Primary Examiner*—Clyde I. Coughenour
*Attorney, Agent, or Firm*—John T. Matlago

[57] ABSTRACT

A writing implement is provided having a body comprised of a pencil end-segment and a pen end-segment. Slideably mounted within the pencil end-segment is a carriage member having a tubular holder for receiving the inner end of a length of lead. The carriage member is provided with a cantilevered arm having an arcuate outer edge which normally bears against serrations provided on the inner wall of the pencil end-segment to effectively lock the carriage member in position. The carriage member can be released and slideably moved to feed the tip of the length of lead for writing by depressing a button on the end of a stem which extends through a longitudinal slot in the pencil end-segment and serves to free the arcuate outer edge of the arm. The pen end-segment, which is threadably detachably connected to the pencil end-segment, encloses a replaceable unit including a magazine for ink and a ball point writing member. An end cap is provided which can be positioned over either the ball point end or the lead end of the body.

1 Claim, 5 Drawing Figures

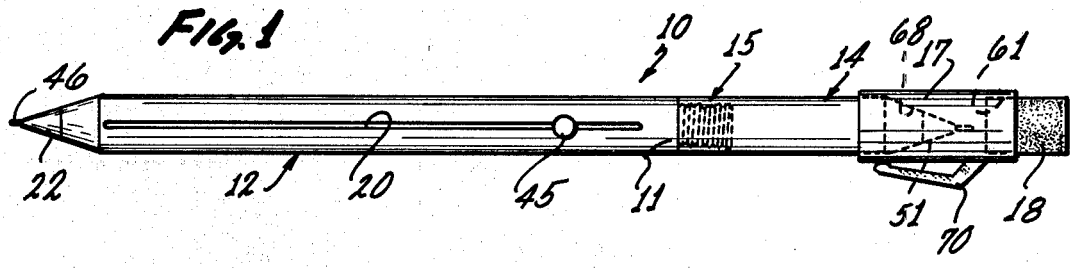
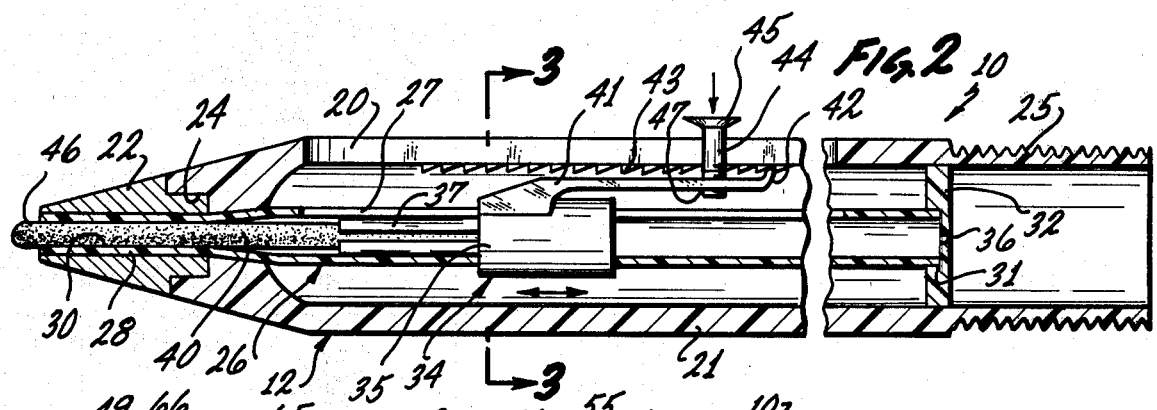
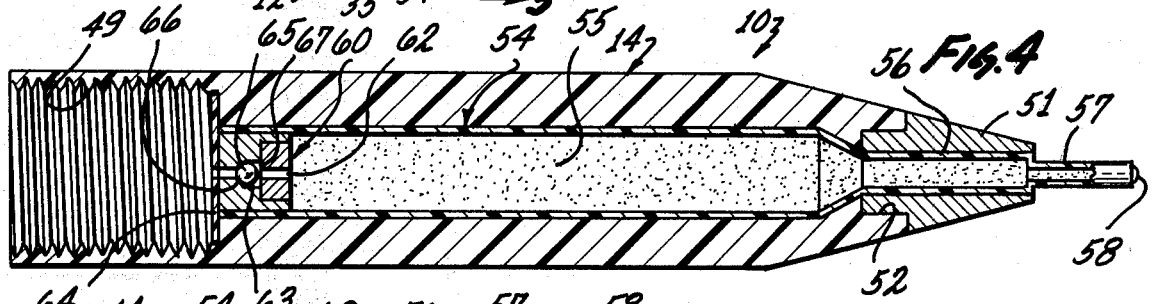
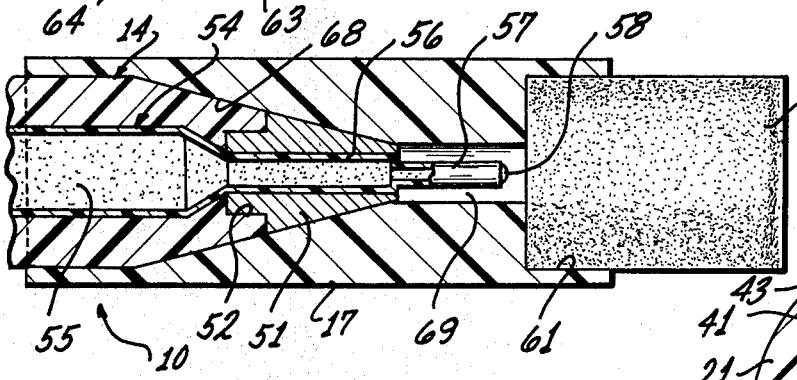
Fig. 5
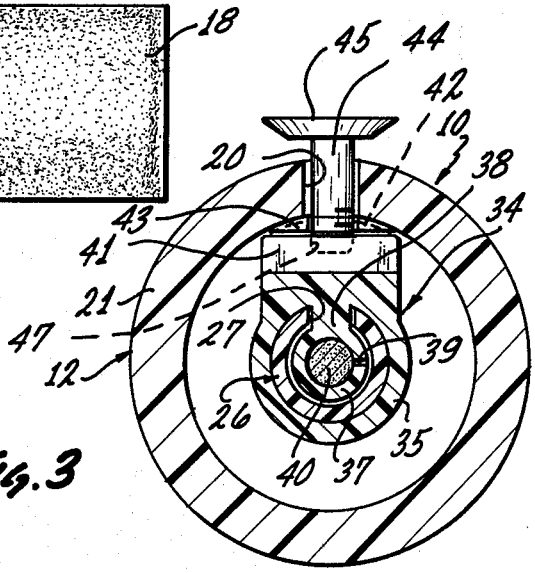
Fig. 3

WRITING IMPLEMENT

BACKGROUND AND SUMMARY OF THE INVENTION

This invention relates to writing implements and more particularly to improvements in structures therefor.

A person often needs both a pen and a pencil at his disposal inasmuch as it is sometimes necessary to write with ink in order to obtain a permanent record of what is written and at other times it is more practical and convenient to write with a lead pencil in order to obtain a record than can be easily erased or changed. The need to have both of these types of writing implements available at one's fingertips during the course of a day can be frustrating at times.

In accordance with the present invention, a writing implement is provided with a body having a pencil end-segment and a pen end-segment. Slideably mounted within the pencil end-segment is a carriage member provided with a tubular holder for receiving the inner end of a length of lead. The carriage member is provided with a cantilevered arm having an arcuate outer edge which normally bears against serrations formed on the inner wall of the pencil end-segment to effectively lock the carriage member in position. The carriage member can be slideably moved to feed the length of lead for writing by depressing a button on the end of a stem which extends through a longitudinal slot in the wall of the pencil end-segment and serves to free the arcuate outer edge of the arm. The pen end-segment encloses a replaceable unit comprised of a magazine for ink of a suitable viscosity and having on the end thereof a steel ball point writing member. The pen end-segment is threadably detachably connected to the end of the pencil end-segment and has its steel ball point writing member normally covered by an end cap.

One of the objects of the present invention is to provide a writing implement having one end-segment thereof structured to serve as a pen and having the other end-segment thereof structured to serve as a pencil.

Another object of the present invention is to provide a writing implement operable by a button on the side of the pencil end-segment thereof for use in feeding a length of lead, as needed, toward the tip thereof.

With these and other objects in view, the invention consists of the construction, arrangement and combination of the various parts of the device, whereby the objects contemplated are attained as hereinafter set forth, pointed out in the appended claims and illustrated in the accompanying drawings.

BRIEF DESCRIPTION OF THE DRAWINGS

FIG. 1 is a side view of the preferred embodiment of the writing implement of the present invention;

FIG. 2 is an enlarged longitudinal sectional view of the pencil end-segment showing the structure provided therein for feeding a length of lead toward the end thereof;

FIG. 3 is a cross sectional view as taken along line 3—3 of FIG. 2;

FIG. 4 is an enlarged longitudinal sectional view of the pen end-segment showing the replacable unit provided therein for feeding ink to the ball point end thereof; and FIG. 5 is an enlarged longitudinal sectional view showing the end cap fitted over the writing end of the pen end-segment.

DESCRIPTION OF THE PREFERRED EMBODIMENT

Referring to FIG. 1 of the drawings, the writing implement 10 of the present invention comprises a body 11 which includes a pencil end-segment 12 and a shorter pen end-segment 14. The inner ends of the pencil and pen end-segments 12 and 14 are detachably connected together as indicated at 15. An end cap 17 carrying an eraser 18 is shown fitted over the ball point writing end portion of the pen end-segment 14.

A longitudinal sectional view of the pencil end-segment 12 is shown in FIG. 2. The pencil end-segment 12 which is preferably made of plastic is hollow and provided with a longitudinal slot 20 on the wall 21 thereof. A tapered end element 22 which is preferably made of metal fits in an opening 24 on the tapered end of the pencil end-segment 12 and may be secured thereto by a cement. The opposite end of the pencil end-segment 12 is provided with external threads 25. As shown in FIG. 2, a metal elongated tube 26 having a smaller diameter outer length portion 28 extends through the longitudinal center of the pencil end-segment 12. The outer end of tube 22 extends through a bore 30 in the end element 22 while the inner end thereof resides in a recess 31 provided on an end wall 32 which may be cemented within the pencil end-segment 12. The elongated tube 26 is provided with a slot 27 along the length thereof opposite the slot 20 on the wall 21 of the pencil end-segment 12. Mounted to slide on the outer surface of the elongated tube 26 is a cylindrical carriage member 34 which is preferably molded of plastic. Thus, as shown in FIG. 3, carriage member 34 is provided with an outer circular wall 35 which has a sliding fit over the outer surface of elongated tube 26. Located concentrically on the cylindrical carriage member 34 is a tubular holder 37 which is connected to the outer circular wall 35 by an integral radial portion 38 which extends through the slot 27 in the elongated tube 26. The tubular holder 37 is formed with a slot 39 along the length thereof to receive the inner end of a length of lead 40, the outer end 46 of which extends out of tube 26.

Preferably integrally formed on one side of the carriage member 34 inward of the longitudinal slot 20 on the wall 21 of pencil end-segment 12 is a cantilevered resilient arm 41 having a radially extending arcuate outer edge 42. The arcuate outer edge 42 normally bears with a slight force in the serrations 43 formed on the inner circumferential surface of the wall 21 of pencil segment 12. A stem 44 having a button 45 on the outer end thereof extends through the slot 20 on the wall 21 and is engaged in a threaded hole 47 located on arm 41 inward of the arcuate outer edge 42 thereof.

A longitudinal sectional view of the pen end-segment 14 of the body 11 of the writing implement 10 is shown in FIG. 4. The pen end-segment 14 is preferably made of plastic and provided with a hollow interior with one end tapered and with internal threads 49 on the outer end surface of the pencil end-segment 12. An end element 51, which may be identical to the end element 22 of the pencil end-segment 12, is fitted in opening 52 on the pencil end-segment 14 and similarly attached thereto. Fitted within the pen end-segment 12 is a replacable unit 54 including a tubular magazine 55 formed with a short capillary end tube 56 having a writing member 57 of smaller diameter on the end thereof carrying a steel ball point 58. The magazine 55 stores ink of a suitable viscosity. A valve member 60 having a plate flange 64 on the outer end thereof closes off the end of the magazine 55. When the pencil segment 12 is threaded on the end of the pen segment 14, the end of threads 25 bears against the flange 64 to hold the unit 54 in the pen end-segment 14. The valve member 60 is provided with a small-bore axial passageway 62 having an enlarged diameter opening 63 midway of the ends thereof for carrying a ball valve 65. The inner end 66 of opening 63 is shaped to seat the ball valve 65 when the writing implement 10 is held with its pencil writing lead end 46 directed downwardly. The outer end 67 of opening 63, on the other hand, is shaped with a clearance fit for opening up the passageway 62 to the atmosphere when the writing implement 10 is held with its ball point end 58 directed downwardly. Note that the passageway 62 is open to the atmosphere by way of a hole 36 in the end wall 32, slot 27 in tube 26, and slot 20 in the wall 21 of the pencil end-segment 12.

Referring to FIG. 5, the end cap 17, which is preferably made of plastic, is shown with an eraser 18 mounted in an opening 61 on the outer end thereof and a tapered internal opening 68 on the inner end thereof whose shape is complementary to the shape of the tapered end elements 22 and 51 on the respective ends of the body 11 formed of end-segments 12 and 14. A space 69 provided within the end cap 17 enables the ball point end 58 or the lead end 46 to reside therein when positioned on the respective ends of the writing implement 10. Thus, the end cap 17 can be fitted on either end of the writing implement 10 while the other end is in use. A clip 70 may be provided on the side of the end cap 17.

To use the writing implement 12, the pen end-segment 14 with the replacable unit 54 therein carrying a supply of suitably viscous ink in the magazine 55 thereof is threadably attached by its internal threads 49 to the external threads 25 on the end of the pencil end-segment 12 to form the single body 11. To load the pencil end-segment 12, the button 45 is depressed causing the arcuate outer edge 42 on arm 41 to be released from the serrations 44 on the inner surface of wall 21 of the pencil end-segment 12. The button 45 is then moved such that the carriage member 34 is slid along the elongated tube 26 toward the writing end of the pencil end-segment 12. The button 45 is then released. A length of lead pencil 40 is then inserted into the reduced diameter portion 28 of the elongated tube 22 by which it is guided so that its inner end is seated and held in the tubular holder 37 on the carriage member 34. The button 45 is then again depressed permitting the carriage member 34 to be moved rearwardly until just enough of the end 46 of the length of lead 40 is sticking out from the pencil end-segment 12 for writing purposes. Note that inasmuch as the ball point end 58 is not retractable it is important that when the writing implement is being used as a pencil that the end cap 17 is securely fitted over the writing end of the pen end-segment 14 to prevent the ball point end 58 from staining the hands or clothing of the user.

It should now be understood that the length of the pencil end-segment 12 and the pen end segment 14 are selected so that when their adjacent ends are threaded together the single body 11 formed has a length suitable for handling by the fingers of the hand. In the embodiment disclosed the pencil end-segment 12 is made approximately $5\frac{1}{8}$ inches in length and the pen end segment 14 is made approximately $1\frac{7}{8}$ inches in length such that when their threaded ends are joined together the overall length of the single body is on the order of $6\frac{1}{4}$ inches. The length of the pencil end-segment is thus on the order of two and one-half times as long as the pen end-segment. However, the individual lengths of the pencil end-segment 12 and the pen end-segment 14 can be made longer or shorter depending on whether it is desired to provide for storing a longer or shorter length of lead or length of ink cartridge 55 within the body 11.

It should now be especially understood that it is highly desirable to be able to detachably connect the pen end-segment 14 from the end of the pencil end-segment 12 so that the former can be opened up to replace the unit 54 when the ink in the cartridge 55 thereof is used up.

While the invention has been concerned with a particular embodiment, it is to be understood that many modifications and variations in the construction and arrangement thereof may be provided for without departing from the spirit and scope of the invention or sacrificing any of its advantages. The invention is, therefore, considered as including all such possible modifications and variations coming within the legitimate and valid scope of the appended claims.

What is claimed is:

1. A writing implement comprising:

a hollow pencil end-segment having a taper on one end thereof and threads on the other end thereof, said pencil end-segment having a longitudinal slot in the wall thereof, the inner surface of said wall adjacent said longitudinal slot being provided with serrations;

a hollow pen end-segment having a taper on one end thereof and threads on the other end thereof, said pencil and pen end-segments having their threaded ends engaged to form a single body;

an elongated tube extending through the longitudinal axis of said pencil end-segment, said elongated tube having a reduced diameter on one end thereof extending through the tapered end of said pencil end-segment and said elongated tube having a longitudinal slot on the wall thereof;

a carriage member within said pencil end-segment, said carriage member having an outer wall which longitudinally slides on the outer surface of said elongated tube;

a tubular holder on the front end of said carriage member adapted to receive the end of a length of lead inserted through the reduced diameter end of said elongated tube;

said tubular holder being connected to the outer wall of said carriage member by a radial portion which extends through the longitudinal slot on said elongated tube;

a cantilevered arm on said carriage member having an arcuate outer edge normally resiliently engaging the serrations on the inner surface of the wall of said pencil end-segment;

a button having a stem extending through the longitudinal slot on the wall of said pencil end-segment and attached to said arm near the arcuate outer edge thereof; and a replacable unit including a magazine for ink within said pen end-segment, said unit having a steel ball point member on the outer end thereof extending out of the tapered end of said pen end-segment.

* * * * *